US010343056B2

(12) United States Patent
Shigeta

(10) Patent No.: US 10,343,056 B2
(45) Date of Patent: Jul. 9, 2019

(54) AUTOMATED REMAINDER DISCARD AND INVENTORY FOR DEALING SHOE

(71) Applicant: Angel Playing Cards Co., Ltd., Shiga (JP)

(72) Inventor: Yasushi Shigeta, Shiga (JP)

(73) Assignee: ANGEL PLAYING CARDS CO., LTD., Higashiomi (JP)

( * ) Notice: Subject to any disclaimer, the term of this patent is extended or adjusted under 35 U.S.C. 154(b) by 40 days.

(21) Appl. No.: 15/535,229

(22) PCT Filed: Dec. 12, 2014

(86) PCT No.: PCT/JP2014/084743
§ 371 (c)(1),
(2) Date: Jun. 12, 2017

(87) PCT Pub. No.: WO2016/092710
PCT Pub. Date: Jun. 16, 2016

(65) Prior Publication Data
US 2017/0326439 A1 Nov. 16, 2017

(51) Int. Cl.
*A63F 1/14* (2006.01)
*A63F 1/06* (2006.01)
*A63F 1/10* (2006.01)

(52) U.S. Cl.
CPC ..... *A63F 1/14* (2013.01); *A63F 1/067* (2013.01); *A63F 1/10* (2013.01); *A63F 2250/58* (2013.01)

(58) Field of Classification Search
CPC .... A63F 1/10; A63F 1/14; A63F 1/062; A63F 2250/58; A63F 2009/2439; G07F 17/3241
See application file for complete search history.

(56) References Cited

U.S. PATENT DOCUMENTS 3,929,339 A 12/1975 Mattioli
6,726,205 B1 * 4/2004 Purton ..... A63F 1/14 273/148 R (Continued)

FOREIGN PATENT DOCUMENTS

JP 5060340 A 5/1975
JP 2005198668 A 7/2005
WO 2013172038 A1 11/2013

OTHER PUBLICATIONS

International Search Report, dated May 19, 2015, for PCT International Application No. PCT/JP2014/084743, filed Dec. 12, 2014.

*Primary Examiner* — Lawrence S Galka
(74) *Attorney, Agent, or Firm* — Norton Rose Fulbright US LLP

(57) ABSTRACT

A card shoe accommodates card decks and includes an opening for manual card withdrawal and a reader. A feeder includes a mechanism, not operated for the manual withdrawal, that feeds the cards from the opening, with the reader reading the fed card's rank; and a controller operating the mechanism to automatically feed all cards in the shoe when use of the decks ends according to a game rule. A control unit calculates a number of cards for each of the ranks based on the read ranks, calculates a total number by adding a number of sheets for each rank of cards manually withdrawn before the end of the deck's use and a number of sheets for each rank of cards fed by the feeder after the end of the deck's use, and compares the total number with a number of cards for each rank that should be in the decks.

20 Claims, 12 Drawing Sheets

(56) References Cited

U.S. PATENT DOCUMENTS

| | | | | |
|---|---|---|---|---|
| 2007/0241498 | A1* | 10/2007 | Soltys | A63F 1/10 273/149 R |
| 2010/0038849 | A1 | 2/2010 | Scheper | |
| 2013/0087972 | A1 | 4/2013 | Snow et al. | |
| 2013/0207344 | A1 | 8/2013 | Shigeta | |
| 2013/0307215 | A1* | 11/2013 | Shigeta | A63F 1/14 273/149 R |

* cited by examiner

Fig. 12

| COMBINATION | POSITIONAL RELATIONSHIP OF MARKS | SENSOR OUTPUT |
|---|---|---|
| 1 | BLANK<br>BLANK | OFF<br>OFF |
| 2 | BLANK<br>M | OFF<br>ON OFF |
| 3 | M<br>BLANK | ON OFF<br>OFF |
| 4 | M<br>M | ON OFF<br>ON OFF |

AUTOMATED REMAINDER DISCARD AND INVENTORY FOR DEALING SHOE

CROSS-REFERENCE TO RELATED APPLICATIONS

This application is a national phase application under 35 U.S.C. § 371 of International Application No. PCT/JP2014/084743, filed 12 Dec. 2014, the entire contents of which is specifically incorporated by reference herein without disclaimer.

TECHNICAL FIELD

The present invention relates to a table game system which is capable of confirming whether a predetermined number of cards in a single package are retained correctly from the time when the cards are accommodated in a card shoe apparatus in a card game by accommodating a plurality of decks of cards in one package in the card shoe apparatus, calculating a total number by adding the number of cards manually withdrawn for use in the game and the number of cards remaining in the card shoe apparatus at the time when the use of the card in the single package is completed, and detecting whether the cards are retained without excess nor insufficiency when being compared to a predetermined number that needs to be properly retained.

BACKGROUND ART

In a game performed in a casino or the like, there is a case where it is necessary to detect fraudulent actions such as losing or stealing of a card, mixing of a fake card, and replacement, and to verify whether a predetermined number of cards (for example, 416 cards of 52 cards×8 decks) in the case of using the eight decks) are retained after ending the game. Conventionally, for example, WO 2013/172038 A (Patent Document 1) discloses a card disposal system of a table game which guarantees that genuine cards in the state of being correctly retained as much as a predetermined number are used in a game table and that the used cards are discarded without being illegally taken out or leaked out.

In this document, the card disposal apparatus has a structure that can receive both cards which are used in each game after a plurality of decks of cards in one package have been set in a card shoe apparatus and cards which remain at a timing when the use of cards inside the card shoe apparatus are ended at a predetermined timing. After the card disposal apparatus receives the used cards and the remaining cards, the total sum of the number of cards is calculated by an examination means of the disposal apparatus, and whether cards to be discarded corresponds to a predetermined number of decks (for example, 416 cards of 52 cards×8 decks) in the case of using the eight decks of cards) is determined.

In this document, however, when it is found that a predetermined number of cards are not retained at the time of discharging cards after end of the game, it is difficult to discriminate whether the cards have not been retained originally at a step of being set in the card shoe apparatus before being used in the game, which is a problem.

SUMMARY OF INVENTION

In the case of the conventional apparatus, examination is performed by setting cards, which have been dispensed from the card shoe apparatus to the game table and used in the game, in a discharge opening of the conventional apparatus, and by allowing a dealer to open a lid of the card shoe apparatus, manually take out remaining cards, and set the cards remaining in a card accommodation portion of the card shoe apparatus in the discharge opening of the conventional apparatus. Therefore, there is room that fraud such as extracting of cards may be performed in these processes. Further, when it is found that the predetermined number of cards (for example, 416 cards of 52 cards×8 decks) in the case of using the eight decks of cards) are not retained at the time of discarding cards after end of the game, there is the problem that it is difficult to discriminate whether the cards have not been retained originally at the step of being set in the card shoe apparatus before being used in the game, which is a problem.

The present invention has been made under such circumstances, and provides a card feeding apparatus including a card feeding mechanism which feeds a card remaining in a card shoe apparatus to the outside of the card shoe apparatus at the time when use of cards in a card accommodation portion of the card shoe apparatus is ended, that is, a system in which at least rank of cards, which are manually withdrawn one by one from the card accommodation portion by a dealer during a game or automatically fed by the card feeding apparatus after use of each card, are read by a card reading unit of the card shoe apparatus, and examination is performed whether a total number of cards, which is obtained by adding at least the number of cards for each rank of individual cards withdrawn during the game and at least the number of cards for each rank of individual cards that have remained in the card accommodation portion without being used in the game and been fed by the card feeding apparatus after ending the use of cards, is excessive or insufficient as compared to the number of cards for each rank that needs to be included in a predetermined number of card decks (for example, 32 cards of 4 cards (heart, spade, ace, and diamond)×8 decks for each rank in the case of using the eight decks).

In addition, a rank of a card is read at the time of being dispensed from the card shoe apparatus to the game table when the card set in the card accommodation portion is used in the game, and it is unnecessary to open the lid of the card shoe apparatus and take out a card at the time of taking out the card remaining in the card accommodation portion of the card shoe apparatus after the use of the card is ended. Thus, all the cards that have been initially set in the card shoe apparatus are eventually read by the card reading unit. Therefore, if it is found that the predetermined number of cards (for example, 416 cards of 52 cards×8 decks in the case of using the eight decks) are not retained at the time of discarding cards after the game is ended, it is possible to discriminate whether the cards have not been retained originally at the step of being set in the card shoe apparatus before being used in the game.

In order to solve the above-described problems of the conventional apparatus, the present invention provides a table game system configured of a predetermined number of a plurality of decks of cards; a package in which the plurality of decks of cards are packed; a card shoe apparatus which includes a card accommodation portion that accommodates the plurality of decks of cards packed in the package, an opening that is configured to manually withdraw cards used in each time of games one by one from the card accommodation portion, and a card reading unit that reads at least ranks of the cards withdrawn from the opening one by one; a card feeding apparatus which is in contact with the cards present in the opening and includes a card feeding mechanism that feeds the cards forward one by one from the opening, a control apparatus that controls an operation of the card feeding mechanism, and an activation means for causing the control apparatus to operate the card feeding mechanism; a card stocker which receives the card fed from the card accommodation portion by the card feeding mechanism; and a management control unit which includes a storage apparatus that stores information on at least the rank of the card read by the card reading unit and is capable of calculating a number of cards for each of the ranks based on the information on at least the rank of each of the cards stored in the storage apparatus. The table game system is configured such that the control apparatus operates the card feeding mechanism so as to automatically feed all cards remaining in the card accommodation portion when the activation unit is activated at time of ending use of the plurality of decks of cards accommodated in the card accommodation portion according to a predetermined rule of a card game, the card feeding mechanism is not operated when a card is manually withdrawn from the card accommodation portion, the card reading unit reads at least the rank of the card fed out by the card feeding apparatus, and the management control unit is configured to have a processing function of calculating a total number of cards by adding a number of cards for each rank of cards manually withdrawn from the card accommodation portion before ending the use of the plurality of decks of cards accommodated in the card accommodation portion according to the predetermined rule of the card game and a number of cards for each rank of cards fed by the card feeding apparatus from the card accommodation portion after ending the use of the cards, and examining whether the total number of cards is excessive or insufficient when being compared with a number of cards for each rank that needs to be included in the predetermined number of the plurality of decks of cards.

According to the table game system of the present invention, at least the rank of the card is read when being dispensed to a game table from the card shoe apparatus when the card is used in the game. Further, it is unnecessary for the dealer to open the lid of the card shoe apparatus and the take out the card when taking out the card remaining the card accommodation portion of the card shoe apparatus at the time when the use of the card in the card accommodation portion is ended. Thus, all the cards which have been initially set in the card shoe apparatus are eventually read by the card reading unit. Accordingly, when it is found that the predetermined number of cards (for example, 416 cards of 52 cards×8 decks in the case of using the eight decks) are not retained at the time of discarding cards after the game is ended, it is possible to discriminate whether the cards have not been retained originally at the step of being set in the card shoe apparatus before being used in the game.

BRIEF DESCRIPTION OF DRAWINGS

FIG. 12 is a diagram illustrating a relationship between output waveforms and marks of sensors in the card shoe apparatus.

DESCRIPTION OF EMBODIMENTS

A detailed description of the present invention will be described below. However, the following detailed description and appended drawings do not limit the invention. Instead, the scope of the invention is defined by the appended claims.

A description will be given regarding a set 1*s* of shuffled playing cards used in a table game system according to a first embodiment of the present invention. Each of the shuffled playing card sets is used in a game table of a casino is configured of a predetermined number of decks (generally, 6, 8, 9 or 10 decks), shuffled in a random order and arranged in a unique and random arrangement order, and are packed as a package PA to which a uniquely identifiable shuffled card ID (a bar code BC, an RFID tag, or the like) is attached as an ID code at a factory. In this embodiment, the ID code is attached to the package PA in the form of the bar code BC (which may be a two-dimensional code such as QR code (registered trademark)) or the form of the RFID tag or the like to be read by a bar code reader R of a card shoe apparatus S or another RFID tag reading means (not illustrated). The package PA is sealed by a sealing material or a shrink packaging material at the factory.

Figure 7:
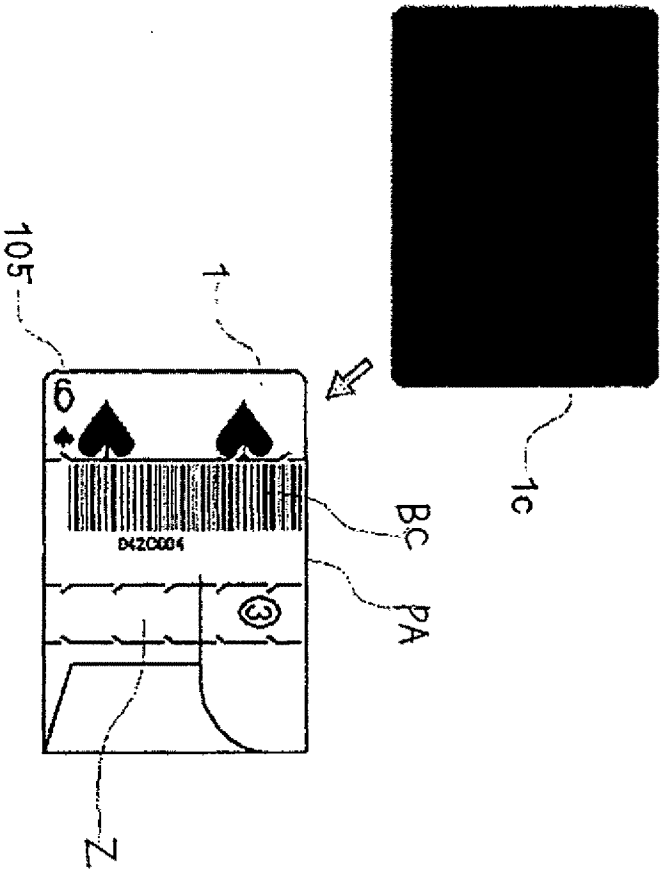
FIG. 7 is a view illustrating an aspect in which a cut card is inserted into a package of a shuffled playing card used in a table game system according to an embodiment of the present invention.
Figure 9:
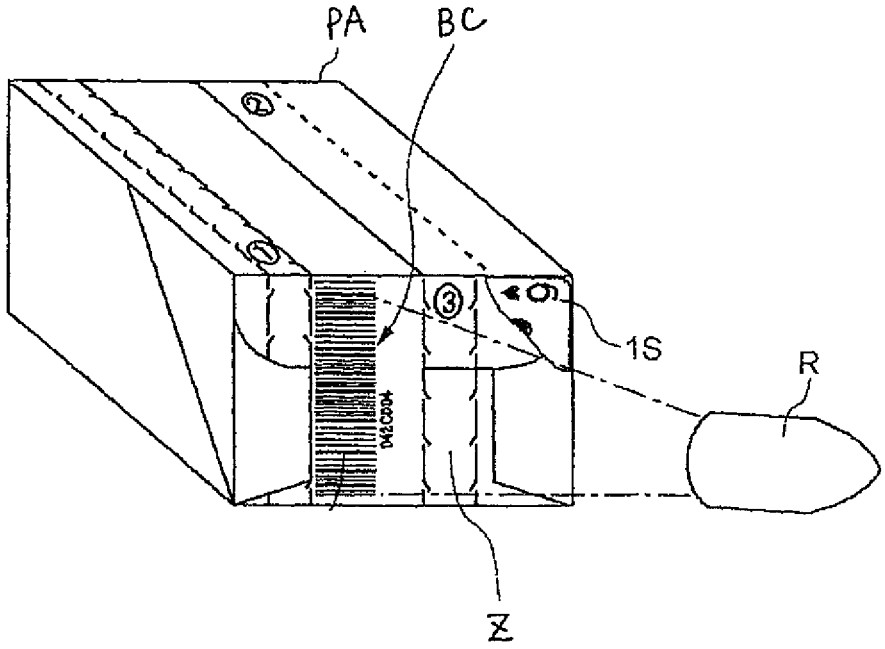
FIG. 9 is a perspective view of the package of the shuffled playing card used in the table game system according to the embodiment of the present invention.
Figure 10:
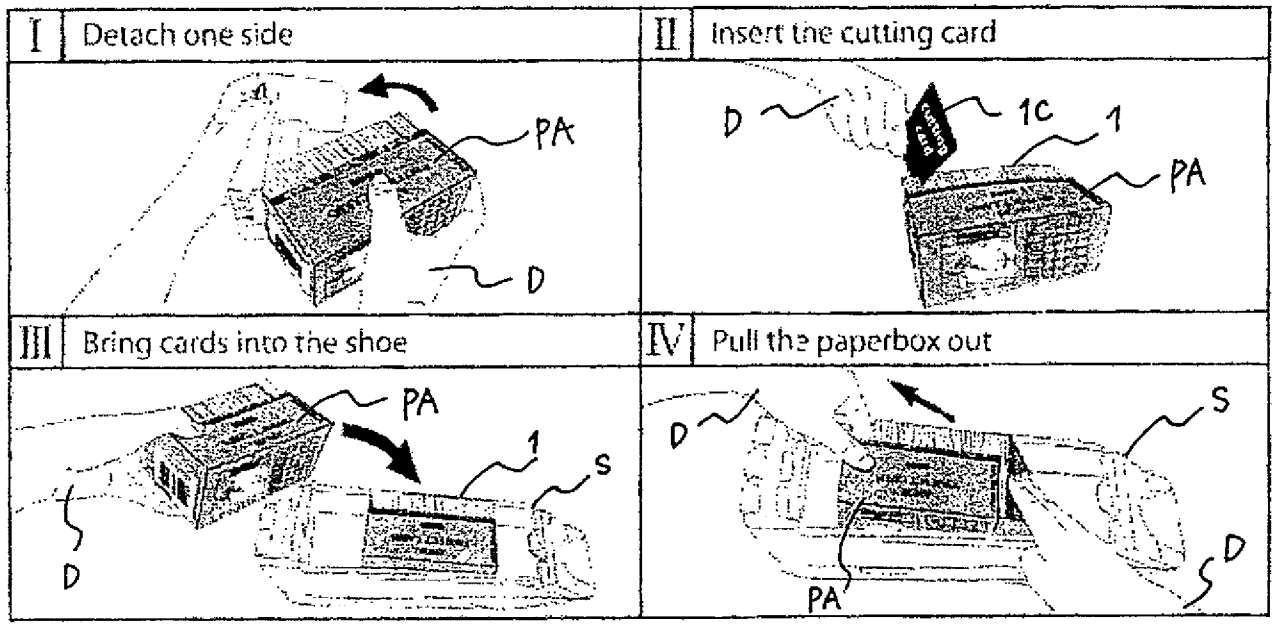
FIG. 10 is an explanatory diagram of a procedure of unsealing and taking out the shuffled playing card from a packing box, and accommodating the shuffled playing card in the card shoe apparatus.

Next, a description will be given regarding a procedure of accommodating the shuffled playing card 1*s* used in the table game system of the present invention in the card shoe apparatus S. As illustrated in FIGS. 9 and 10, at the time of accommodating the shuffled playing card set 1*s* packed in the package PA in the card shoe apparatus S, a side face of the package PA is removed along a cut line Z provided in the package PA, a part of the shuffled playing card set 1*s* is set to be exposed, and then, the set 1*s* is grasped, lifted up, and accommodated into a card accommodation portion 2 of the card shoe apparatus S. Incidentally, a cut card 1*c*, for stopping in the middle use of the shuffled playing card set is in a subsequent card game, may be inserted at the time of setting a part of the shuffled playing card set 1*s* to be exposed (see FIGS. 7 and 10). After accommodating the shuffled playing card set is in the card accommodation portion 2, a part of the remaining package PA is removed from the card accommodation portion 2, and only the shuffled playing card set 1*s* is left in the card accommodation portion 2, thereby completing the accommodation.

Next, the card shoe apparatus S used in the table game system of the present invention will be described. The card shoe apparatus S includes: a card accommodation portion 2 that accommodates a plurality of the shuffled playing cards 1*s*; a lid 3 that is provided on a top of the card accommodation portion 2; an opening 6 which is configured to take out shuffled playing cards 1 when a dealer D or the like of a casino manually withdraws the shuffled playing cards one by one from the card accommodation portion 2 toward a game table 4; a card reading unit 110 that reads information representing at least the numeral (rank) of the shuffled playing cards 1; a storage apparatus 20 which stores at least information on a rank of a card read by the card reading unit 110; and a management control unit 19 that is capable of calculating the number of cards per rank based on the information on at least the rank of each card stored in the storage apparatus 20. Incidentally, the card reading unit 110 may have a structure to read a code C of the card 1 using UV sensors 120 and 121 to be described later, a structure to read an index 105 that has been printed on the shuffled playing card 1 with a camera or the like, or a structure of combining the both structures.

A card pressing portion 32 including a roller 31 is disposed behind the shuffled playing card 1 accommodated in the card accommodation portion 2, and a slope is provided so that the card accommodation portion 2 descends forward. Thus, it is configured such that the shuffled playing card 1 is always pressed to the front from the back by the card pressing portion 32. Thus, the shuffled playing card 1 at the foremost position among the shuffled playing card sets 1*s* accommodated in the card accommodation portion 2 reaches the vicinity of a front end portion of the card accommodation portion 2, and a part of the foremost shuffled playing card 1 is exposed to the outside through the opening 6.

Here, the above-described cut card 1*c* is inserted into a rear half portion (the remnants are about one fourth or one fifth) of the shuffled playing card set 1*s* at the time of using the shuffled playing card set 1*s* in a game. Thus, when the shuffled playing cards 1 of the shuffled playing card set 1*s* accommodated in the card shoe apparatus S are withdrawn and used one by one in the game, the cut card 1*c* is used to end the game in a state where about 20 to 40 cards are left in the card shoe apparatus S in order to prevent the numeral (rank) of the distributed shuffled playing cards 1 from being counted by a player and the numeral (rank) of the remaining shuffled playing cards 1, which is few, from being predicted. Generally, when the cut card 1*c* is withdrawn during a game, the use of the shuffled playing card set 1*s* accommodated in the card shoe apparatus S is ended at the time of ending the corresponding game, the subsequent game after the withdrawal of the cut card 1*c*, or a game after a predetermined number of times after the withdrawal of the cut card 1*c*, and the shuffled playing card 1 remaining in the card shoe apparatus S is replaced with a new shuffled playing card set 1*s*. A code representing the cut card 1*c* may be attached to the cut card 1*c*, and the card reading unit 110 may be configured to be able to read the cut card 1*c*.

Here, when the shuffled playing card 1 remaining in the card accommodation portion 2 of the card shoe apparatus S is removed and replaced with the new shuffled playing card set 1*s*, conventionally, the dealer D opens the lid 3 of the card shoe apparatus S and manually takes out the shuffled playing card 1 so that there is a possibility that problems such as extraction and a loss may occur. In the present invention, it is possible to take out the shuffled playing card 1 remaining in the card accommodation portion 2 of the card shoe apparatus S using a card feeding apparatus 11 without using the above-described method. Details will be described below.

As described above, when the use of the shuffled playing card set 1*s* accommodated in the card shoe apparatus S is ended at the time when the game after the predetermined number of times played after the withdrawal of the cut card 1*c* is ended, the card 1 that has not been used in the game remains in the card accommodation portion 2. The card shoe apparatus S in this state will be mounted to the card feeding apparatus 11, and the card 1 remaining without being used in the game will be automatically fed to the outside of the card shoe apparatus S by the card feeding apparatus 11. When the card feeding apparatus 11 automatically feeds the card 1 to the outside of the card shoe apparatus S, the card reading unit 110 reads at least the rank of the card 1 to be fed out, and this information is stored in the storage apparatus 20. The management control unit 19 calculates at least the number of cards 1 fed by the card feeding apparatus 11 for each rank based on the information on at least the rank of each of the cards 1 stored in the storage apparatus 20.

Next, details of the card feeding apparatus 11 will be described with reference to FIGS. 1 to 4. The card feeding apparatus 11 has a rectangular parallelepiped shape, and includes a cradle 12, which supports the card shoe apparatus S at a bottom face, at a lower part and a front cover 13 which covers a front portion of the card shoe apparatus S by allowing the card shoe apparatus S to be fit therein, at a front part and a card stocker 14 which accommodates the fed card 1. Two rollers 17 (a roller (1) and a roller (2)) are provided on the rear face of the front cover 13, and these two rollers 17 are installed at a position in contact with the card 1 present at the opening 6 of the apparatus S when the card shoe apparatus S is mounted to the card feeding apparatus 11. Further, the roller 17 is connected to a motor 18 configured to move the roller 17, and a card feeding mechanism 26 is configured of the rollers 17 and the motor 18. The motor 18 is connected to a control apparatus 16 inside the card feeding apparatus 11, and an activation means 15 for operating the control apparatus 16 is provided at the rear face of the front cover 13. The roller (1) is brought into contact with the foremost card 1 among the shuffled playing cards 1 remaining in the card accommodation portion 2 of the card shoe apparatus S, and is configured such that the foremost card 1 among the shuffled playing cards 1 is withdrawn from the card shoe apparatus S by a frictional force along with the rotation of the rollers 17. Further, the shuffled playing card 1 withdrawn from the card shoe apparatus S by the roller (1) is fed into the card stocker 14 by the roller (2) and accumulated therein.

After the use of the card 1 accommodated in the card accommodation portion 2 is completed, the card shoe apparatus S is placed on an upper face of the cradle 12, and the card shoe apparatus S is mounted such that a front part thereof is fitted to an inner side of the front cover 13. When the card shoe apparatus S is mounted to the card feeding apparatus 11 in this manner, the activation means 15 provided in the rear face of the front cover detects the card shoe apparatus and performs the activation. When the activation means 15 performs the activation, a signal to move the motor 18 is fed to the control apparatus 16, and the motor 18 is operated. When the motor 18 is operated, the rollers 17 are driven to rotate, and the card 1 in contact with the roller among the cards 1 remaining in the card accommodation portion 2 is withdrawn forward.

Thereafter, the card withdrawn forward by the rollers is further accumulated in the card stocker 14 positioned in front of the opening 6 of the card shoe apparatus S. When the rollers are driven to rotate in this manner, the cards remaining in the card accommodation portion are successively withdrawn forward and accommodated in the card stocker 14. As the above-described motions are repeated, all the cards 1 remaining in the card accommodation portion 2 are accommodated in the card stocker 14. When all the cards 1 remaining in the card accommodation portion 2 are withdrawn from the card accommodation portion 2 and the card 1 in contact with the rollers 17 disappears, the operation of the rollers 17 is stopped. Alternatively, the roller 17 may be provided with an additional stop means (not illustrated) so that the operation of the roller 17 is stopped when the stop means is activated. Incidentally, it is impossible to automatically feed a card using a feeding apparatus at the time of manually feeding the card.

At least the number of cards for each rank of the cards 1 which have been manually withdrawn before the use of the card 1 accommodated in the card accommodation portion 2 is ended and at least the number of cards for each rank of the cards 1 fed by the card feeding apparatus 11 after the use of the card 1 is ended, which are stored in the storage apparatus 20, are added by the management control unit 19, and examination is performed on whether the total number of cards is excessive or insufficient as compared to the number of cards that should be included in a predetermined number of decks. For example, when a game is started in a state where the package PA of the shuffled playing cards 1 configured of eight decks is accommodated in the card accommodation portion 2 of the card shoe apparatus S, there should be eight cards in each rank. Accordingly, the number of cards 1 for each rank is calculated, and whether eight cards are present for the entire rank and there is no excess or insufficiency is examined in a manner such that "whether there are 32 cards of 8 decks×4 types (heart, spade, clover, diamond) for A, whether there are 32 cards of 8 decks×4 types (heart, spade, clover, diamond) for 2, and so on". This can be changed depending on setting such that whether the excess or insufficiency is examined by comparing information for each suit that needs to be included in a predetermined number of card decks (for example, 104 cards of 13 cards×8 decks for each suit in the case of using the eight decks) and information for each combination of the rank and the suit (for example, 8 cards for each combination of the rank and the suit in the case of using the eight decks).

An examination result, obtained by examining whether there is no excess or insufficiency when being compared to the information on the number of the shuffled playing cards 1 that should be included in the predetermined number of card decks using the management control unit 19, is displayed in a display means 21. In the display means 21, it is possible to display the information on at least the rank in which the excess or insufficiency exists when it is found to be failed as the examination result. Furthermore, with regard to the information on at least the rank read by the card reading unit 110 and stored in the storage apparatus 20, it is possible to acquire only the information either the information on the number of cards for each rank of the individual shuffled playing cards 1 manually withdrawn during the game or the information on the number of cards for each rank of the shuffled playing cards 1 remaining in the card accommodation portion 2 at the time when the use of the card 1 in the card accommodation portion 2 is ended and fed by the card feeding apparatus 11. In addition, it is also possible to display the information on the number of cards for each rank of the individual shuffled playing cards 1 withdrawn during the game and the information on the number of cards for each rank of the shuffled playing cards 1 remaining in the card accommodation portion 2 of the card shoe apparatus S without being used in the game together depending on the setting. Further, it is also possible to display the information on the number of cards for each suit of the individual shuffled playing cards 1 withdrawn during the game and the information on the number of cards for each suit of the shuffled playing cards 1 remaining in the card accommodation portion 2 of the card shoe apparatus S without being used in the game, and to display the information on the number of cards for each combination of the rank and the suit of the individual shuffled playing cards 1 withdrawn during the game and the information on the number of cards for each combination of the rank and the suit of the shuffled playing cards 1 remaining in the card accommodation portion 2 of the card shoe apparatus S without being used in the game.

In addition, when the cards 1 included in a new package PA are accommodated in the card accommodation portion 2, the ID code attached to the package PA may be read by the bar code reader R of the card shoe apparatus S, and then, results, obtained by sequentially reading at least ranks of the cards 1 withdrawn from the card shoe apparatus S to be used in a game using the card reading unit 110, and information on at least the rank, which is read by the card reading unit 110 when the cards 1 remaining in the card accommodation portion 2 at the time when the use of the card 1 in the card accommodation portion 2 is ended is fed to the outside by the card feeding apparatus 11, may be stored in the storage apparatus 20 in association with information on a shuffled card ID read by the bar code reader R. In that case, it is also possible to display a shuffled card ID of a card as an object to be displayed together at the time of displaying the result of examination of the card and the information on the card in the display means 21.

In addition, the examination result, obtained by examining whether there is no excess or insufficiency when being compared to the information on the number of the shuffled playing cards 1 that should be included in the predetermined number of card decks using the management control unit 19, is transmitted to a pit, a backyard, or the like by a transmission means 22. The transmission means 22 can perform the transmission together with the information on at least the rank where the excess or insufficiency exists when it is found to be failed as the examination result. Furthermore, with regard to the information on at least the rank read by the card reading unit 110 and stored in the storage apparatus 20, it is also possible to transmit only the information either the information on the number of cards for each rank of the individual shuffled playing cards 1 manually withdrawn during the game or the information on the number of cards for each rank of the shuffled playing cards 1 remaining in the card accommodation portion 2 at the time when the use of the card 1 in the card accommodation portion 2 is ended and fed by the card feeding apparatus 11. In addition, it is also possible to transmit the information on the number of cards for each rank of the individual shuffled playing cards 1 withdrawn during the game and the information on the number of cards for each rank of the shuffled playing cards 1 remaining in the card accommodation portion 2 of the card shoe apparatus S without being used in the game together depending on the setting. Further, it is also possible to transmit the information on the number of cards for each ante suit of the individual shuffled playing cards 1 withdrawn during the game and the information on the number of cards for each suit of the shuffled playing cards 1 remaining in the accommodation portion of the card shoe apparatus 4 without being used in the game, and to transmit the information on the number of cards for each combination of the rank and the suit of the individual shuffled playing cards 1 withdrawn during the game and the information on the number of cards for each combination of the rank and the suit of the shuffled playing cards 1 remaining in the card accommodation portion 2 of the card shoe apparatus S without being used in the game. In addition, it is also possible to transmit a shuffled card ID of a card as an object to be transmitted together at the time of transmitting the information exemplified as above using the transmission means 22.

When abnormality is detected as a result of the examination in the management control unit 19, a warning output means 23 can inform the abnormality to the outside. In addition, the warning output means 23 to inform the abnormality may light a display lamp 23 in an arbitrary color or may generate a warning sound. When the examination result is found to be acceptable, the warning output means 23 may be used to light the display lamp in a color different from that in the case of abnormality or to generate a sound using a sound different from that in the case of abnormality depending on setting.

Incidentally, the management control unit 19 may be included in the card feeding apparatus 11 or included inside the card shoe apparatus S.

Figure 1:
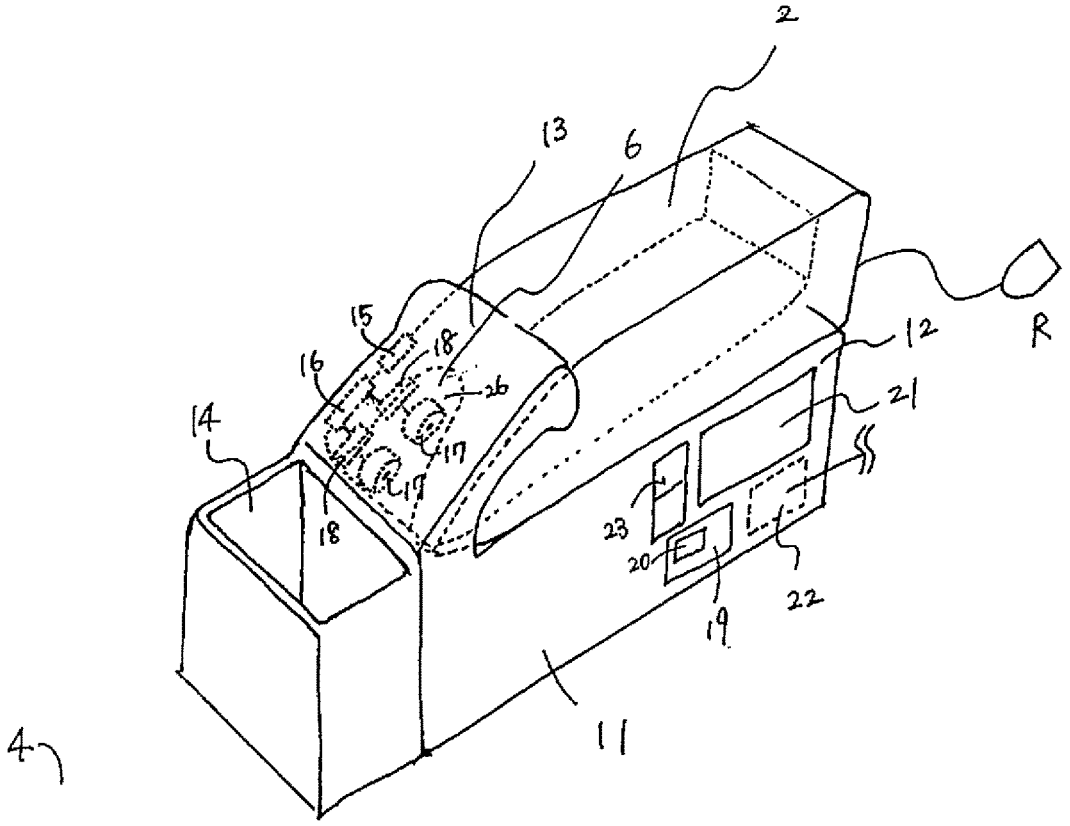
FIG. 1 is a perspective view of a card feeding apparatus and a card shoe apparatus according to a first embodiment of the present invention.
Figure 2:
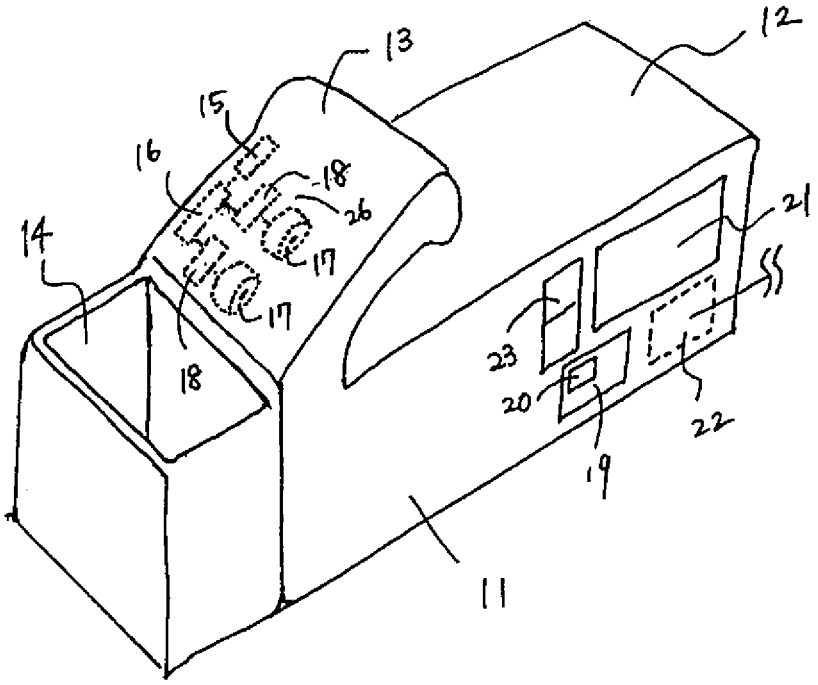
FIG. 2 is a perspective view of the card feeding apparatus according to the first embodiment of the present invention.
Figure 3:
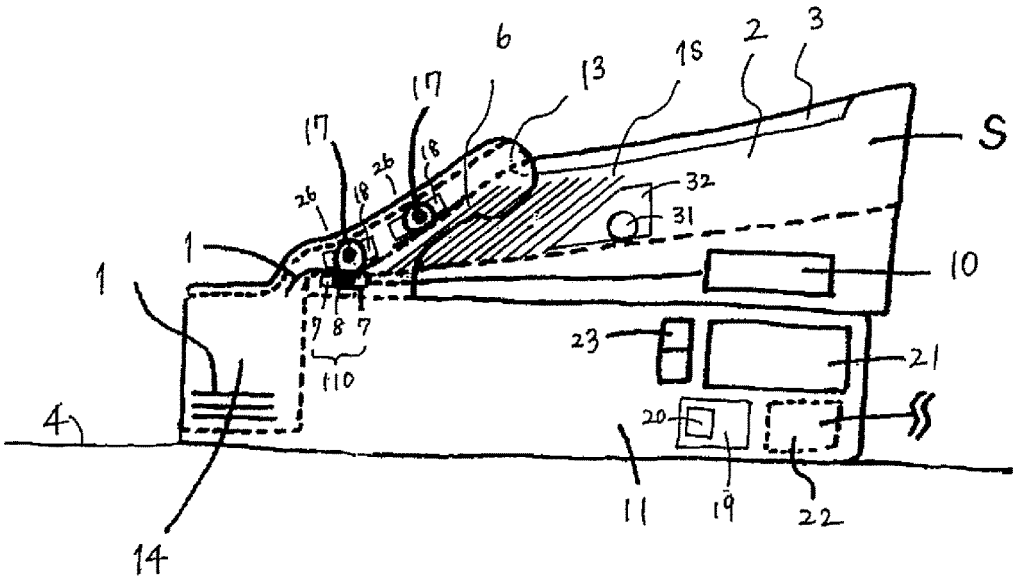
FIG. 3 is a side cross-sectional view of the card feeding apparatus and the card shoe apparatus according to the first embodiment of the present invention.
Figure 4:
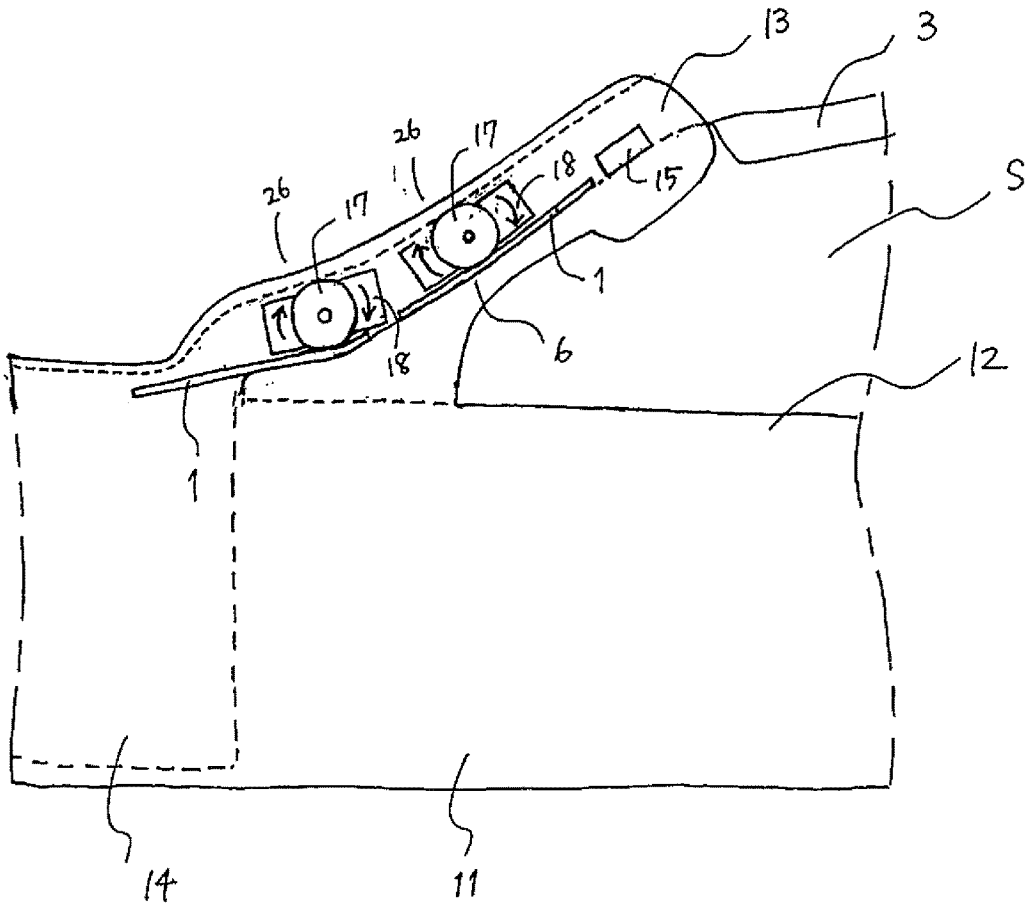
FIG. 4 is an enlarged side cross-sectional view of an enlarged main part of each opening portion of the card feeding apparatus and the card shoe apparatus according to the first embodiment of the present invention.
Figure 5:
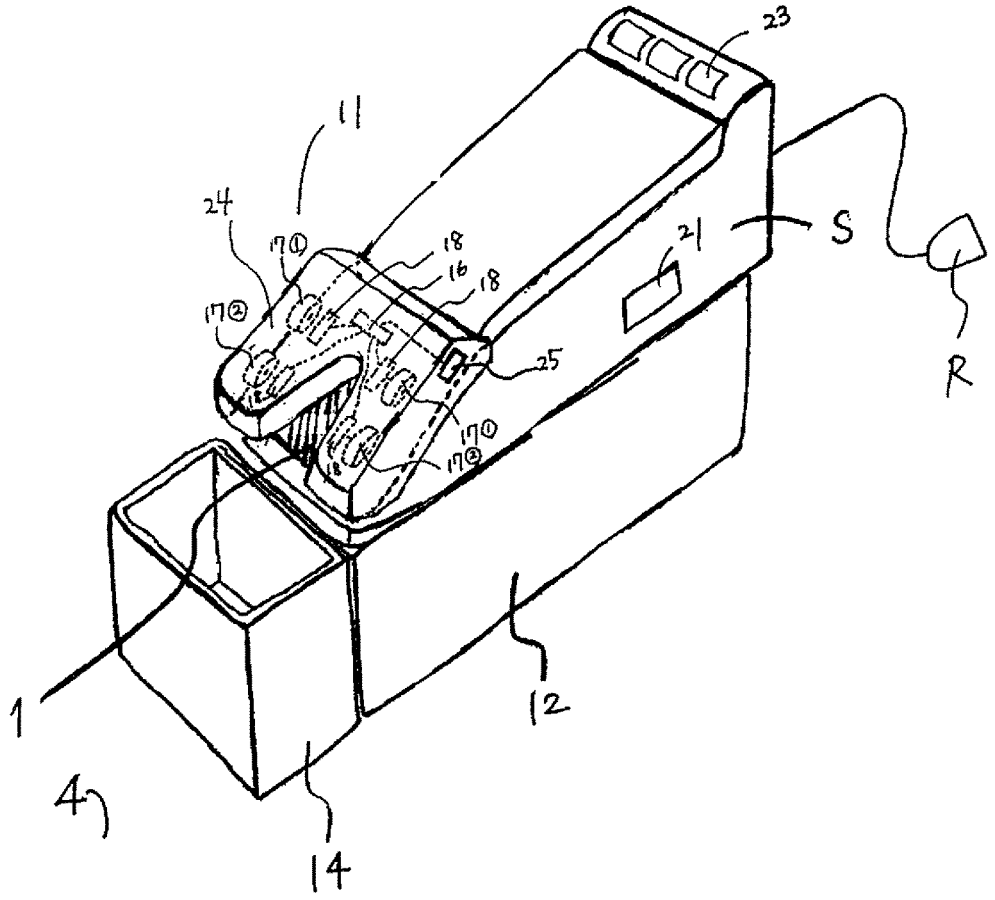
FIG. 5 is a perspective view of a card shoe apparatus including a card feeding apparatus, a card stocker, and a cradle according to a second embodiment of the present invention.
Figure 6:
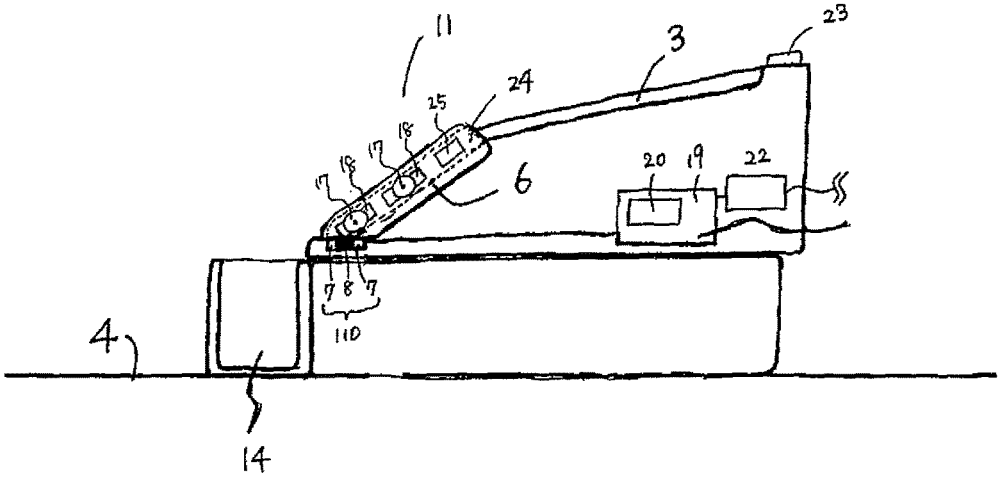
FIG. 6 is a side cross-sectional view of the card shoe apparatus including the card feeding apparatus, the card stocker, and the cradle according to the second embodiment of the present invention.

Next, a modified example of the card feeding apparatus 11 will be described. In FIGS. 5 and 6, the card feeding apparatus 11 forms a part of the card shoe apparatus S. The card feeding apparatus 11 is provided in a form of an inverted U-shaped plate 24 and can be mounted on the front face of the card accommodation portion 2 so as to cover the front face of the card accommodation portion 2 of the card shoe apparatus S. The opening 6 is formed to withdraw the card 1 from the card accommodation portion 2 to the game table 4. Four rollers 17 in total are provided at up and down, left and right on a back face of the plate 24. (Upper rollers (1) and lower rollers (2)). These four rollers 17 are positioned to be in contact with the card 1 on the foremost face of the card accommodation portion 2 of the card shoe apparatus S. Each of the rollers 17 is connected to the motor 18 configured to move the roller 17, and the card feeding mechanism 26 is configured of the rollers 17 and the motor 18. The motor 18 is connected to the control apparatus 16, and a switch 25 configured to operate the control apparatus 16 is provided on a front face of the plate 24. The roller 17(1) is brought into contact with the foremost card 1 among the shuffled playing cards 1 remaining in the card accommodation portion 2 of the card shoe apparatus S, and is configured such that the foremost card 1 among the shuffled playing cards 1 is withdrawn from the card shoe apparatus S by a frictional force along with the rotation of the roller 17(1). Further, the shuffled playing card 1 withdrawn from the card shoe apparatus S by the rollers 17(1) is fed into the card stocker 14 by the rollers 17(2) and accumulated therein.

When the dealer D manually withdraws the card 1 from the card accommodation portion 2 during a card game, the four rollers 17 play a role of making slip of the card 1 favorable. When the switch 25 on the front face of the plate 24 is activated after the use of the card 1 accommodated in the card accommodation portion 2 is ended, the signal to move the motor 18 is fed to the control apparatus 16, and the motor 18 is operated. When the motor 18 is operated, the roller 17 is driven to rotate, and the card 1 in contact with the roller 17 among the cards 1 remaining in the card accommodation portion 2 is withdrawn forward. At this time, when the card shoe apparatus is installed on the rectangular parallelepiped cradle 12 and the card stocker 14 is installed at the lower part of the opening 6 of the card shoe apparatus S in front of the cradle 12, the card 1 fed by the roller 17 can be received and accumulated by the card stocker 14.

When the roller 17 is driven to rotate in this manner, the card 1 remaining in the card accommodation portion 2 is successively withdrawn forward and accommodated in the card stocker 14. As the above-described motions are repeated, all the cards 1 remaining in the card accommodation portion 2 are accommodated in the card stocker 14. When all the cards 1 remaining in the card accommodation portion 2 are withdrawn from the card accommodation portion 2 and the card 1 in contact with the rollers 17 disappears, the operation of the rollers 17 is stopped. Alternatively, the roller 17 may be provided with the additional stop means (not illustrated) so that the operation of the roller 17 is stopped when the stop means is activated.

Figure 8:
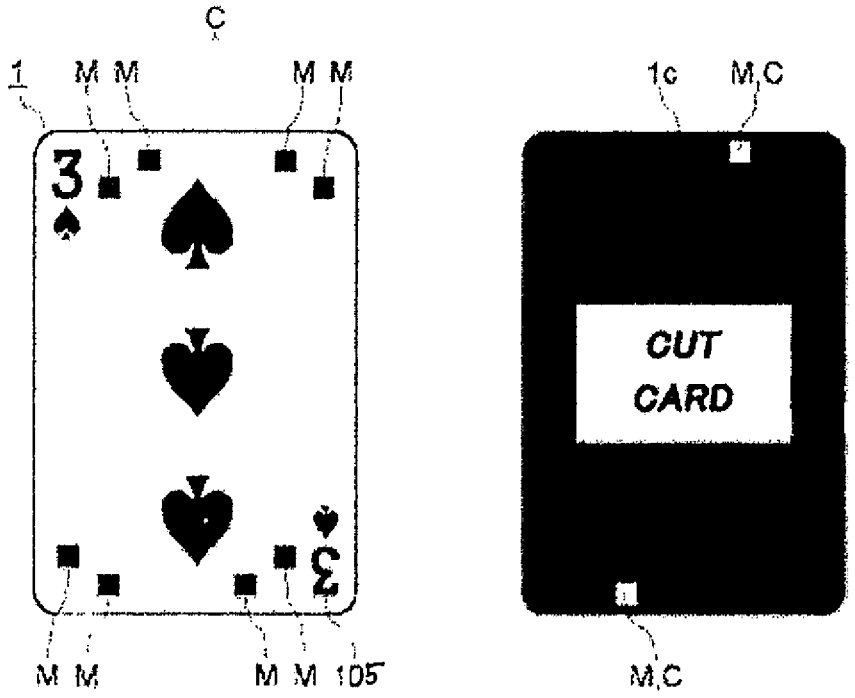
FIG. 8 is a plan view of a card according to an embodiment of the present invention.

Next, a card forming the shuffled playing card set is according to the embodiment of the present invention will be described with reference to FIG. 8. The rank (numeral) of each card is encoded and printed on each of the cards 1 used in the table game such as baccarat using a UV ink or the like, as a mark M which is normally invisible. The code C configured of the marks M is point-symmetrically provided on an upper side and a lower side of the card 1. It is desirable that the code C be printed using a paint that is visualized by receiving ultraviolet light and be printed at a position not overlapping with indication for a card type indication or the index 105.

Figure 11:
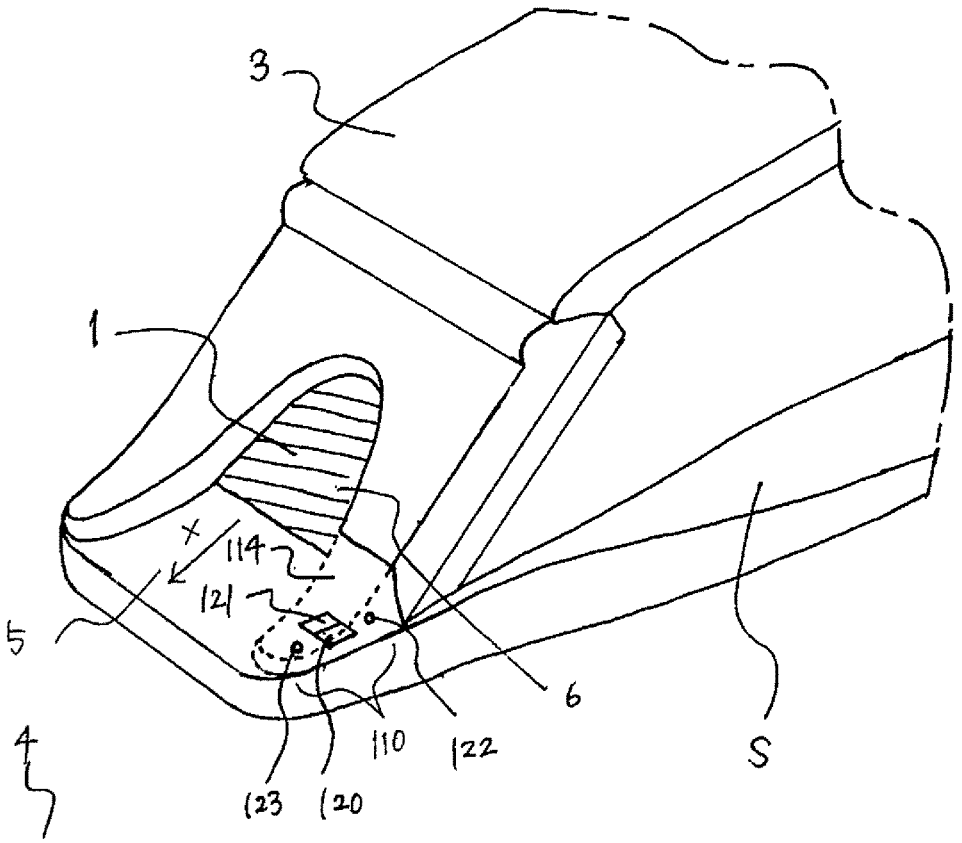
FIG. 11 is an enlarged perspective view of a main part in a state where a card reading unit at a tip end of the card shoe apparatus is exposed.

Next, a description will be given regarding details of the card reading unit 110 that reads the code C representing the rank (numeral) of the card 1 from the card 1 when the card 1 is withdrawn from the card accommodation portion 2 with reference to FIG. 11. FIG. 11 is an enlarged perspective view of a main part in a state where the card reading unit 110 at a tip end of the card shoe apparatus S is exposed. In FIG. 11, the card reading unit 110 is provided in a card guide portion 5 that guides the cards 1, withdrawn one by one from the opening 6 in front of the card accommodation portion 2, onto the game table 4. The card guide portion 5 is an inclined surface, and card guide covers 114 also serving as sensor covers are attached to both edge portions. In addition, each of the two card guide covers 114 can be attached and detached using screws (not illustrated). When the card guides 114 are removed, four sensors of the card reading unit 110 are exposed. The four sensors are configured of two ultraviolet reaction sensors (UV sensors) 120 and 121 and object detection sensors 122 and 123.

The object detection sensors 122 and 123 are optical fiber sensors that detect presence or absence of the card 1 and can detect the motion of the card 1. The object detection sensor 122 is positioned on an upstream side of the card guide portion 5 along a flow direction (arrow X) of the card 1, and the other object detection sensor 123 is positioned on the downstream side. As illustrated in FIG. 11, both the object detection sensors 122 and 123 are provided on the upstream side and the downstream side with the UV sensors 120 and 121 interposed therebetween. Each of the UV sensors 120 and 121 is provided with an LED (ultraviolet LED) emitting ultraviolet rays and a detector. The mark M of the code C is printed on the card 1 using an ultraviolet light emitting ink which develops color when being shun with the ultraviolet rays. The card 1 is irradiated with the ultraviolet rays (black light), and reflected light of the mark M of the code C of the card 1 is detected by the detector. The UV sensors 120 and 121 are connected to the control unit 10 of the card reading unit 110 via cables. The card reading unit 110 determines a combination of the marks M from output signals of the detectors of the UV sensors 120 and 121, and determines the numeral (rank) corresponding to each of the codes C.

The card reading unit 110 controls start and end of reading of the UV sensors 120 and 121 using the control unit 10 based on detection signals of the object detection sensors 122 and 123. In addition, the control unit 10 also determines whether the card 1 has normally passed the card guide portion 5 based on the detection signals of the object detection sensors 122 and 123. As illustrated in FIG. 8, the quadrangular marks M representing the rank (numeral) and suit (heart, spade, or the like) of the card are arranged in two rows and four rows at an edge of the card 1. When detecting the marks M, the UV sensors 120 and 121 output an ON signal. The card reading unit 110 determines a correlation between two signals input from the two UV sensors 120 and 121. Accordingly, the card reading unit 110 identifies the code based on a relative difference or the like between the two marks M detected by the two UV sensors 120 and 121, and identifies the numeral (rank) and the type (suit) of the corresponding card 1.

FIG. 12 illustrates a relationship between the code C and output of the ON signals of the two UV sensors 120 and 121. A predetermined combination of the marks M can be identified on the basis of a comparison result of relative changes of output of the ON signals of the UV sensors 120 and 121. As a result, it is possible to form 256 types of codes as a fourth power of four types when four types of the combination of the marks M in upper and lower two rows are printed for four rows. Each of 52 types of cards of playing cards is assigned to any of the 256 types of codes, and results thereof are stored in a memory or a program as a reference table. The card reading unit 110 is configured to identify the numeral (rank) and the type (suit) of the card 1 from the reference table (not illustrated) set in advance by identifying the respective codes C. In addition, the 256 types of codes can be stored using the reference table to be freely combined and associated with the 52 types of cards, and thus, it is possible to make the combinations complicated, and to change the combinations between the 256 types of code and the 52 types of cards depending on time and locations. It is desirable that the code be printed using a paint that is visualized by receiving ultraviolet light and be printed at a position not overlapping with indication for a card type indication or the index 105.

Although the various embodiments of the present invention have been described as above, it is a matter of course that the above-described embodiments can be modified by those skilled in the art within a scope of the present invention. For example, fraud in games other than baccarat may be detected according to the present invention. At this time, the apparatuses according to the present embodiments may be appropriately modified in response to the necessity of the game to be applied.

REFERENCE SIGNS LIST

1 card
1*s* shuffled playing card set
1*c* cut card
2 card accommodation portion
3 lid
4 game table
5 card guide portion
6 opening
7 card detection unit
8 card reading unit
10 control unit
11 card feeding apparatus
12 cradle
13 front cover
14 card stocker
15 activation means
16 control apparatus
17 roller
18 motor
19 management control unit
20 storage apparatus
21 display means
22 transmission means
23 warning output means
24 plate
25 switch (activation means)
26 card feeding mechanism
31 roller
32 card pressing portion
105 index
C code
M mark
110 card reading unit
114 sensor cover (card guide cover)
120, 121 UV reaction sensor (UV sensor)
122, 123 object detection sensor
PA package
Z zipper
R bar code reader
D dealer
S card shoe apparatus
BC bar code

The invention claimed is:

1. A table game system comprising:
a predetermined number of a plurality of decks of cards;
a package in which the plurality of decks of cards are packed;
a card shoe apparatus comprising:
a card accommodation portion configured to accommodate the plurality of decks of cards packed in the package;
an opening that is configured to enable manual withdrawal of cards one by one from the card accommodation portion; and
a card reading unit configured to read at least ranks of the cards withdrawn via the opening one by one;
a card feeding apparatus in contact with the cards present in the opening, the card feeding apparatus comprising:
a card feeding mechanism configured to feed the cards forward one by one from the opening;
a control apparatus configured to control an operation of the card feeding mechanism; and
activation means for causing the control apparatus to operate the card feeding mechanism;
a card stocker configured to receive the cards fed from the card accommodation portion by the card feeding mechanism; and
a management control unit comprising a storage apparatus configured to store information indicating at least the rank of the cards read by the card reading unit and configured to calculate a number of cards for each of the ranks based on the information indicating at least the rank of each of the cards stored in the storage apparatus, wherein the control apparatus is configured to operate the card feeding mechanism so as to automatically feed all cards remaining in the card accommodation portion when the activation means is activated at a time of ending use of the plurality of decks of cards accommodated in the card accommodation portion according to a predetermined rule of a card game, wherein the card feeding mechanism is not operated when a card is manually withdrawn from the card accommodation portion, wherein the card reading unit reads at least the rank of the card fed out by the card feeding apparatus, and wherein the management control unit is configured to:

calculate a total number of cards by adding a number of cards for each rank of cards manually withdrawn from the card accommodation portion before ending the use of the plurality of decks of cards accommodated in the card accommodation portion according to the predetermined rule of the card game and a number of cards for each rank of cards fed by the card feeding apparatus from the card accommodation portion after ending the use of the cards; and examine whether the total number of cards is excessive or insufficient when being compared with a number of cards for each rank that needs to be included in the predetermined number of the plurality of decks of cards.

2. The table game system according to claim 1, wherein the card feeding apparatus is detachable from the card shoe apparatus.

3. The table game system according to claim 1, wherein the card feeding apparatus is included in the card shoe apparatus.

4. The table game system according to claim 1, wherein the predetermined number of the plurality of decks of cards includes a cut card, and the time of ending the use of the plurality of decks of cards accommodated in the card accommodation portion is an end time of any game between a game in which withdrawal of the cut card occurs and a number, set in advance, of games after the withdrawal of the cut card occurs.

5. The table game system according to claim 1, further comprising means for outputting whether a result of an examination performed by the management control unit is acceptable or failed, and outputting or transmitting a rank for which a number of cards are insufficient together with the result when the result indicates a failed examination.

6. The table game system according to claim 1, wherein:

the management control unit is configured to be capable of acquiring only either the information associated with the manually withdrawn cards or the information associated with the cards automatically fed by the card feeding apparatus.

7. The table game system according to claim 1, further comprising warning output means for outputting a warning when a result of an examination performed by the management control unit indicates that the total number of cards is excessive or deficient.

8. The table game system according to claim 1, wherein:

a unique ID is individually attached to the package in which the predetermined number of the plurality of decks of cards are packed, and the table game system further comprises an ID code reader configured to read the unique ID attached to the package.

9. The table game system according to claim 8, further comprising means for outputting a result of an examination performed by the management control unit together with the unique ID, and, when the result indicates a failed examination, outputting or transmitting the rank for which the number of cards is insufficient together with the result.

10. The table game system according to claim 1, wherein the card feeding mechanism includes a roller, and wherein the card feeding mechanism is configured to feed the cards remaining in the card accommodation portion to the card stocker.

11. The table game system according claim 1, wherein the management control unit is included in the card shoe apparatus.

12. The table game system according to claim 1, wherein the management control unit is included in the card feeding apparatus.

13. A table game system comprising:

a card shoe apparatus comprising:

a card accommodation portion configured to receive a package of cards; and a card reading unit configured to read ranks of the cards manually withdrawn from the card accommodation portion via an opening defined in the card shoe apparatus;

a card feeding apparatus comprising:

a card feeding mechanism configured to feed the cards from the card accommodation portion to a card stocker; and a control apparatus configured to activate the card feeding mechanism to automatically feed the cards remaining in the card accommodation portion at an end time of use of the cards in the card accommodation portion according to a game rule, wherein the card feeding mechanism is not operated when a card is manually withdrawn from the card accommodation portion, and wherein the card reading unit is further configured to read the ranks of the cards fed by the card feeding apparatus; and a management control unit configured to:

store information indicating the ranks of the cards read by the card reading unit;

calculate, for each rank, a first number of cards by adding the cards of the corresponding rank of the cards manually withdrawn from the card accommodation portion before the end time based on the information;

calculate, for each rank, a second number of cards by adding the cards of the corresponding rank of the cards fed by the card feeding apparatus from the card accommodation portion after the end time based on the information;

calculate, for each rank, a total number of cards by adding the first number for the corresponding rank and the second number for the corresponding rank; and compare, for each rank, the total number of cards to a number of cards for the corresponding rank in the package of cards to determine whether the total number of cards for the corresponding rank is excessive or insufficient.

14. The table game system according to claim 13, wherein:

a unique ID is attached to the package; and the unique ID indicates the number of cards for each rank in the package of cards.

15. The table game system according to claim 14, further comprising an ID code reader configured to read the unique ID attached to the package.

16. The table game system according to claim 13, further comprising means for outputting a result of an examination performed by the management control unit indicating whether the total number of cards for each rank is excessive or deficient.

17. The table game system according to claim 13, wherein:

the card reading unit is further configured to read suits of the cards manually withdrawn from the card accommodation portion and of the cards fed by the card feeding apparatus;

the management control unit is further configured to:

calculate a total number of cards for each suit; and compare the total number of cards for each suit to a number of cards for the corresponding suit in the package of cards to determine whether the total number for cards for each suit is excessive or insufficient.

18. A table game system comprising:

a card shoe apparatus comprising:

a card accommodation portion configured to receive a package of cards; and a card reading unit configured to read ranks and suits of the cards manually withdrawn from the card accommodation portion via an opening defined in the card shoe apparatus;

a card feeding apparatus comprising:

a card feeding mechanism configured to feed the cards from the card accommodation portion to a card stocker; and a control apparatus configured to activate the card feeding mechanism to automatically feed the cards remaining in the card accommodation portion at an end time of use of the cards in the card accommodation portion according to a game rule, wherein the card feeding mechanism is not operated when a card is manually withdrawn from the card accommodation portion, and wherein the card reading unit is further configured to read the ranks and the suits of the cards fed by the card feeding apparatus; and a management control unit configured to:

store information indicating the ranks and the suits of the cards read by the card reading unit;

for a particular rank and suit combination:

calculate a first number of cards by adding the cards of the particular rank and suit combination of the cards manually withdrawn from the card accommodation portion before the end time based on the information;

calculate a second number of cards by adding the cards of the particular rank and suit combination of the cards fed by the card feeding apparatus from the card accommodation portion after the end time based on the information;

calculate a total number of cards by adding the first number for the particular rank and suit combination and the second number for the particular rank and suit combination; and compare the total number of cards to a number of cards for the particular rank and suit combination in the package of cards to determine whether the total number of cards for the particular rank and suit combination is excessive or insufficient.

19. The table game system according to claim 18, wherein:

the card feeding mechanism is configured to feed the cards remaining in the card accommodation portion to a card stocker;

a unique ID is attached to the package; and the unique ID indicates the number of cards for each rank and suit combination in the package of cards.

20. The table game system according to claim 19, further comprising:

an ID code reader configured to read the unique ID attached to the package; and means for outputting a result of an examination performed by the management control unit indicating whether the total number of cards for each rank and suit combination is excessive or deficient.

* * * * *